US007194976B1

(12) United States Patent
Kramer

(10) Patent No.: US 7,194,976 B1
(45) Date of Patent: Mar. 27, 2007

(54) BOAT COVER

(76) Inventor: Timothy A. Kramer, 2800 S. 1st St., Blue Springs, MO (US) 64014

( * ) Notice: Subject to any disclaimer, the term of this patent is extended or adjusted under 35 U.S.C. 154(b) by 0 days.

(21) Appl. No.: 11/299,861

(22) Filed: Dec. 12, 2005

(51) Int. Cl.
*B63B 17/02* (2006.01)
*E04H 15/04* (2006.01)

(52) U.S. Cl. ..... 114/361; 135/90

(58) Field of Classification Search ..... 114/361; 135/90; 296/26.05; 405/218, 219
See application file for complete search history.

(56) References Cited

U.S. PATENT DOCUMENTS 3,481,073 A * 12/1969 Yoshida et al. ..... 47/17
4,448,224 A 5/1984 Crain
4,487,212 A 12/1984 Moore
4,830,427 A 5/1989 Fiocchi
4,991,612 A 2/1991 Kiss et al.
5,086,799 A 2/1992 Lumbleau
5,269,332 A 12/1993 Osborne
5,709,501 A 1/1998 Elbers
5,769,105 A 6/1998 Margol et al.
5,775,353 A 7/1998 Johnson
6,167,658 B1 1/2001 Weiner
6,397,774 B1 6/2002 Pranger

* cited by examiner

*Primary Examiner*—Jesús D. Sotelo
(74) *Attorney, Agent, or Firm*—Shook, Hardy & Bacon LLP

(57) ABSTRACT

A boat cover system for covering a boat. The boat cover system is attached to an existing structure and includes a track assembly, a roller assembly, and a cover. The track assembly includes at least one section of track and a coupling assembly for attaching the track assembly to the existing structure. The roller assembly is slidingly coupled to the track and includes a pulley system that moves the cover from a first position to a second position.

22 Claims, 4 Drawing Sheets

BOAT COVER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

This invention relates to an improved boat cover and more particularly to a boat cover that is attached to an existing structure that is easily installed and removed by the user.

Typical boat covers in the industry are made from fabric and are either custom made to fit an exact type or style of boat or are standard items that are sized generally according to the size of the boat. These boat covers typically must be removed and installed each time the boat is to be used. Once the boat cover is removed it is usually folded and stored in somewhere on the dock or the boat. Depending on the size of the boat, the cover can become extremely cumbersome and heavy once it is folded. Further, the cover typically requires a number of people for removal or installation. Still further, removal or installation is a dirty and time-consuming process for the users.

Other types of boat covers exist that attach to a boat dock and may be lowered and tied. However, once the cover has been removed from the boat it remains suspended above the slip where the boat is docked. Further, installation of the boat cover requires multiple people as the cover, once lowered, must be secure around the perimeter of the boat. This process is also time-consuming.

Accordingly, it would be desirable to manufacture a boat cover that is easy to install, inexpensive, and easy to operate.

BRIEF SUMMARY

One objective of the present invention is to provide a cover system installed on a boat dock and covering a boat. In one embodiment, the cover system includes a track assembly, a roller assembly, and a cover assembly. The track assembly includes a track and an attachment assembly. The track is coupled to the boat dock via the attachment assembly. The roller assembly includes a plurality of pulleys, a plurality of rollers, and a pair of cords. The rollers contain a pair of wheels that are received within the track and ride therewithin. The pulleys serve to move the cover assembly from a first position to a second position wherein the second position the cover assembly is covering the boat. The cover assembly consists of a cover and an attachment member. In use, the cover simply slips over the boat and covers it as the cover assembly is moved from the first position to the second position.

Additional advantages, and novel features of the invention, will be set forth in part in a description which follows and will become apparent to those skilled in the art upon examination of the following, or may be learned by practice of the invention.

BRIEF DESCRIPTION OF THE DRAWINGS

In the accompanying drawings which form a part of the specification and which are to be read in conjunction therewith, and in which like reference numerals are used to indicate like parts in the various views.

DETAILED DESCRIPTION

Figure 1:
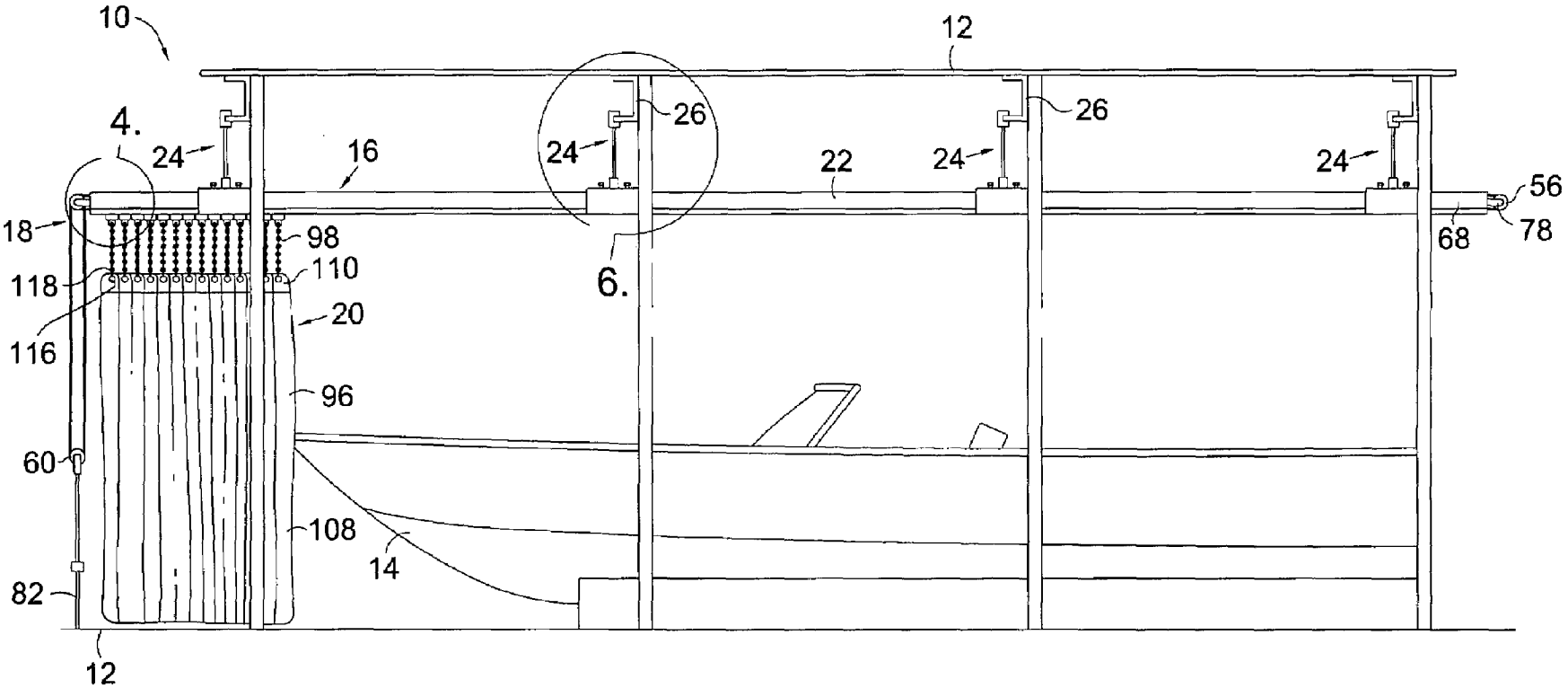
FIG. 1 is a side-elevation view of a boat cover system attached to a boat dock with the cover in the uncovered position.
Figure 2:
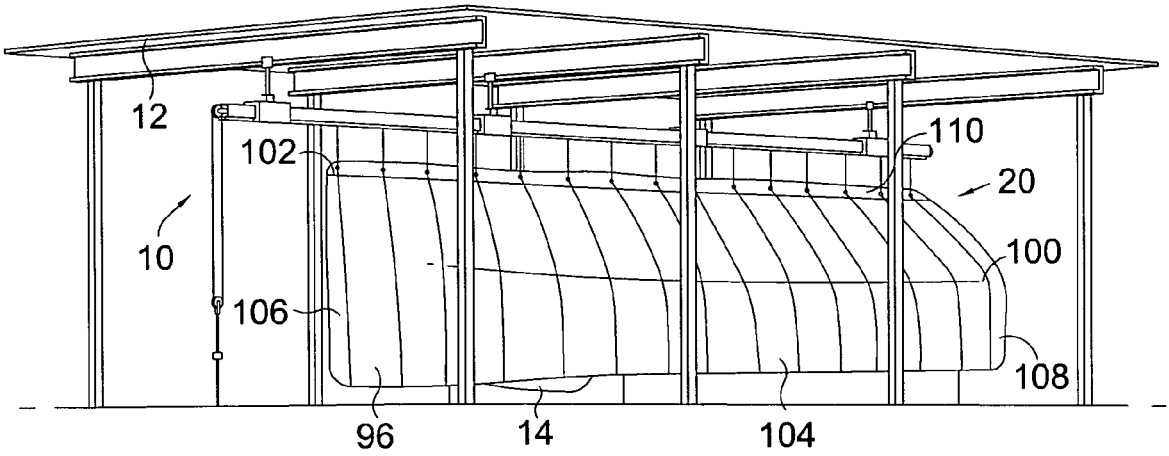
FIG. 2 is a perspective view of the boat cover system with the cover in the covered position covering a boat.

Referring to the drawings in greater detail and to FIGS. 1 and 2, a cover system is shown and is designated generally by the numeral 10. FIG. 2 shows the cover system 10 in installed on a boat dock 12 and covering a boat 14. While the boat 14 is shown on a lift in FIGS. 1 and 2, it should be appreciated by one of ordinary skill in the art that the cover system 10 works on a boat 14 that remains in the water. Referring again to FIG. 1, the cover system 10 includes a track assembly 16, a roller assembly 18, and a cover assembly 20. The track assembly 16 includes a track 22 and an attachment assembly 24. The dimensions of the track 22 generally correspond to the dimensions of the boat 14. Specifically, the track 22 is made from anodized aluminum and generally runs the length of the boat 14. However, it should be understood by one of ordinary skill in the art that any suitable material may be used.

Figure 6:
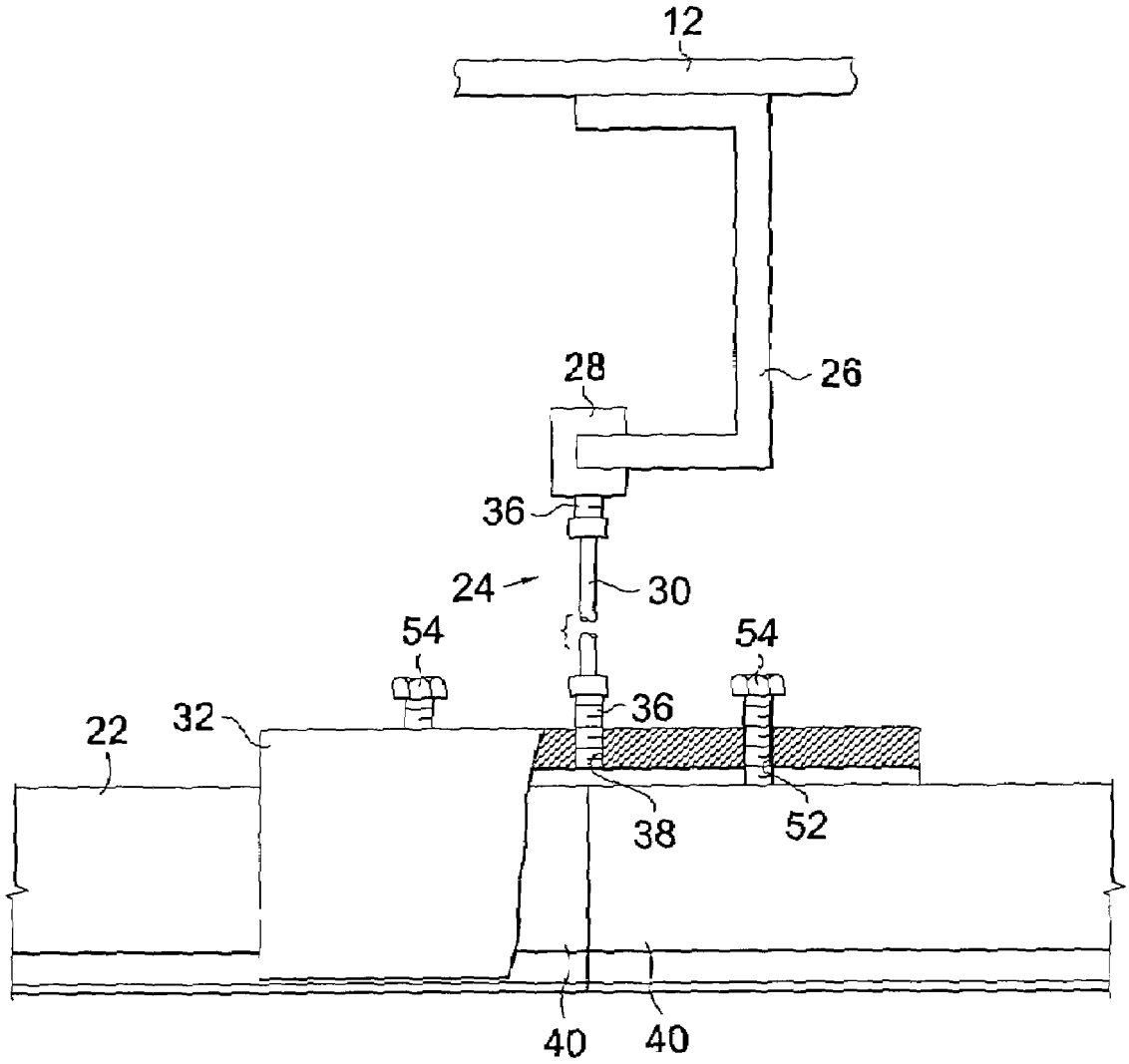
FIG. 6 is a partial, enlarged view of the track and the pulley assembly with parts broken away.

As shown in FIGS. 1 and 6 the track 22 is coupled to the boat dock 12 via the attachment assembly 24. Specifically, the track 22 is coupled to a beam 26 on the boat bock 12 via the attachment assembly 24. The attachment assembly 24 includes a plurality of clamps 28, a plurality of rods 30, and a plurality of collars 32. The clamps 28 are connected to the beam 26 in a manner well known in the art. It should be appreciated by one of ordinary skill in the art that the type of clamps are not meant to be limiting and may be coupled to any suitable portion of the boat dock 12. The clamps 28 further contain a threaded aperture 34, not shown. Each rod 30 has a pair of threaded ends 36 one of which is threadably received in the threaded aperture 34 of the clamp 28 while the other is threadably received in a threaded aperture 38 in the collar 32, as will be further discussed below. Thus, the rods 30 interconnect the clamps 28 and the collars 32. The threaded connection between the clamps 28, the rods 30, and collars 32 is known in the art. Further, it should be appreciated that any suitable attachment method between the clamps 28, the rods 30, and collars 32 may be used.

Figure 5:
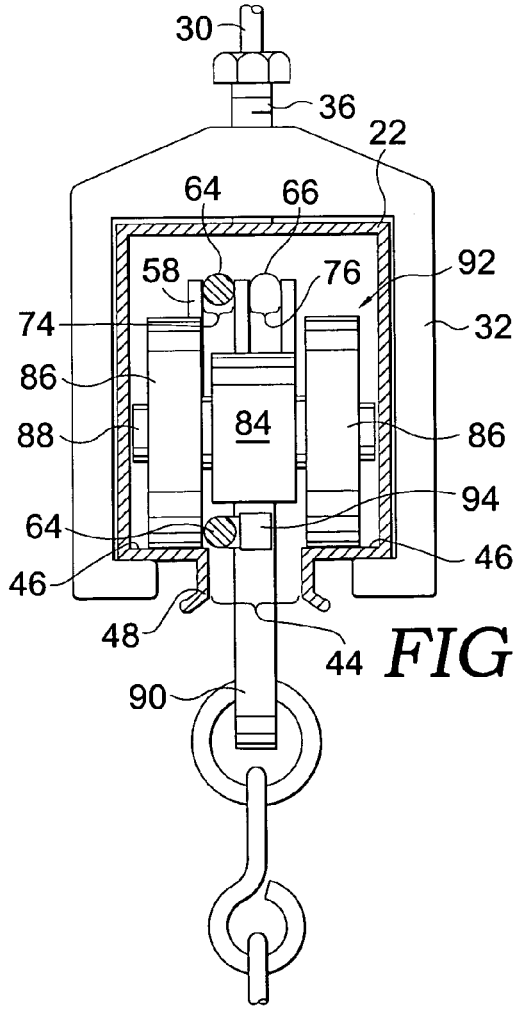
FIG. 5 is a partial, rear, enlarged view of the track and the attachment assembly.

As shown in FIGS. 5 and 6, the track 22 includes a plurality of sections 40 that are coupled together via the collars 32. However, it should be appreciated by one of ordinary skill in the art that the track 22 may be a single, integral piece. The multiple sections 40 of track 22 allow the cover system 10 to be adapted to correspond to the size of the boat 14. It also provides the ability to disassemble the boat cover system 10 for ease during shipping. The track 22 contains a rectangular cross section with a elongate opening 44 along its length, a pair of roller surfaces 46, and a pair of downwardly depending lips 48, the purpose of each will be discussed below. As stated above, the sections 40 of track 22 are coupled together by the collars 32. The collars 32 include a rectangular cross section that mates with the cross section of each section of the track 22. It should be understood that the cross section of the track and collars can be any suitable cross section for supporting the pulley assembly 18. As stated above, the collar 32 includes a threaded aperture 38 that receives the threaded end 36 of the rod 30. The collar 32 also includes a pair of threaded apertures 52 that receive bolts 54 to clamp the track 22 within the collar 32 to interconnect the track sections 40. Thus, the collars 32 are capable of connecting adjoining sections 40 of track 22 as well as supporting the track 22 when it is coupled to the boat dock 12. However, it should be understood that the collars may also simply support the track 22 without serving to interconnect track sections 40.

Figure 4:
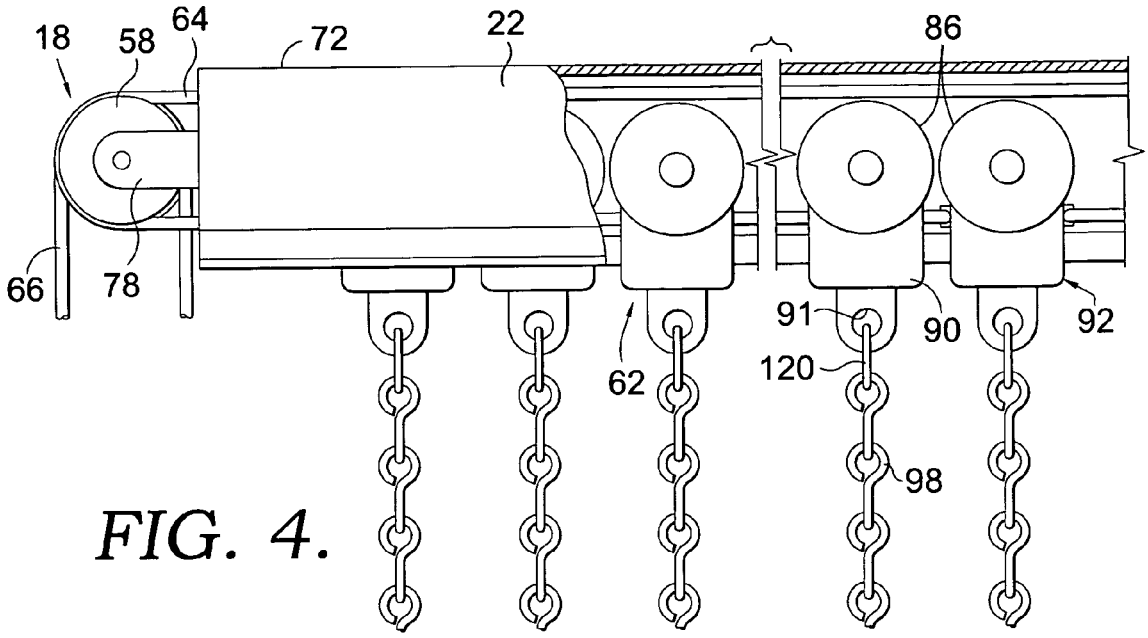
FIG. 4 is a partial, enlarged view of the pulley assembly and the track assembly with parts broken away.

As shown in FIGS. 1, 4, and 5, the roller assembly 18 includes a plurality of pulleys 56, 58, 60, a plurality of rollers 62, and first and second cords 64, 66. The first pulley 56 is located at a first end 68 of the track 22 and coupled thereto. The first pulley 56 is a single pulley having a channel 70, not shown, that receives the first cord 64 as will be further discussed below. The second pulley 58 is located at a second end 72 of the track 22 in the same plane as the first pulley 56. The second pulley 58 is a double pulley having first and second channels 74, 76 that receive the first and second cords 64, 66 respectively. The first and second pulleys 56, 60 are connected to the track via couplers 78. The third pulley 60 is located remotely from the second pulley 58. The third pulley 60 is a single pulley having a channel 80, not shown, that receives the second cord 66. It should be understood that the channels 70, 80 of the first and third pulleys 56, 60 are similar to the channels 74, 76 of the second pulley 60 with the exception that the first and third pulleys 56, 60 each contain a single channel 70, 80. The third pulley 60 is coupled to the dock 12 by a connector 82. However it should be understood by one of ordinary skill in the art that any suitable coupling apparatus may be used.

Thus, the first cord 64 operationally couples the first and second pulleys 56, 58. Specifically, the first cord 64 is received in the channel 70, not shown, of the first pulley 56 and the first channel 74 of the second pulley 56. The second cord 66 operationally couples the second and third pulleys 58, 60. Specifically, the second cord 66 is received in the second channel 76 of the second pulley 56 and the channel 80, not shown, of the third pulley 58.

Referring now to FIGS. 4 and 5, the rollers 62 will be discussed. The rollers 62 contain a central section 84 and a pair of wheels 86 rotatably coupled to the central section 84 by an axle 88. The pair of wheels 86 are received within the track 22 and ride on the roller surfaces 46. The central section 84 contains a member 90 that extends between the downwardly extending lips 48. The lips 48 serve to guide the rollers 62 as they move along the track 22. The member 90 further contains an aperture 91 that is used to attach the cover assembly 20. The first cord 64 is coupled to a pulling roller 92 by a clamp 94. The pulling roller 92 is the same as the other rollers with the exception that it is attached to the first cord 64. The operation of the roller system 18 will be discussed below.

Figure 3:
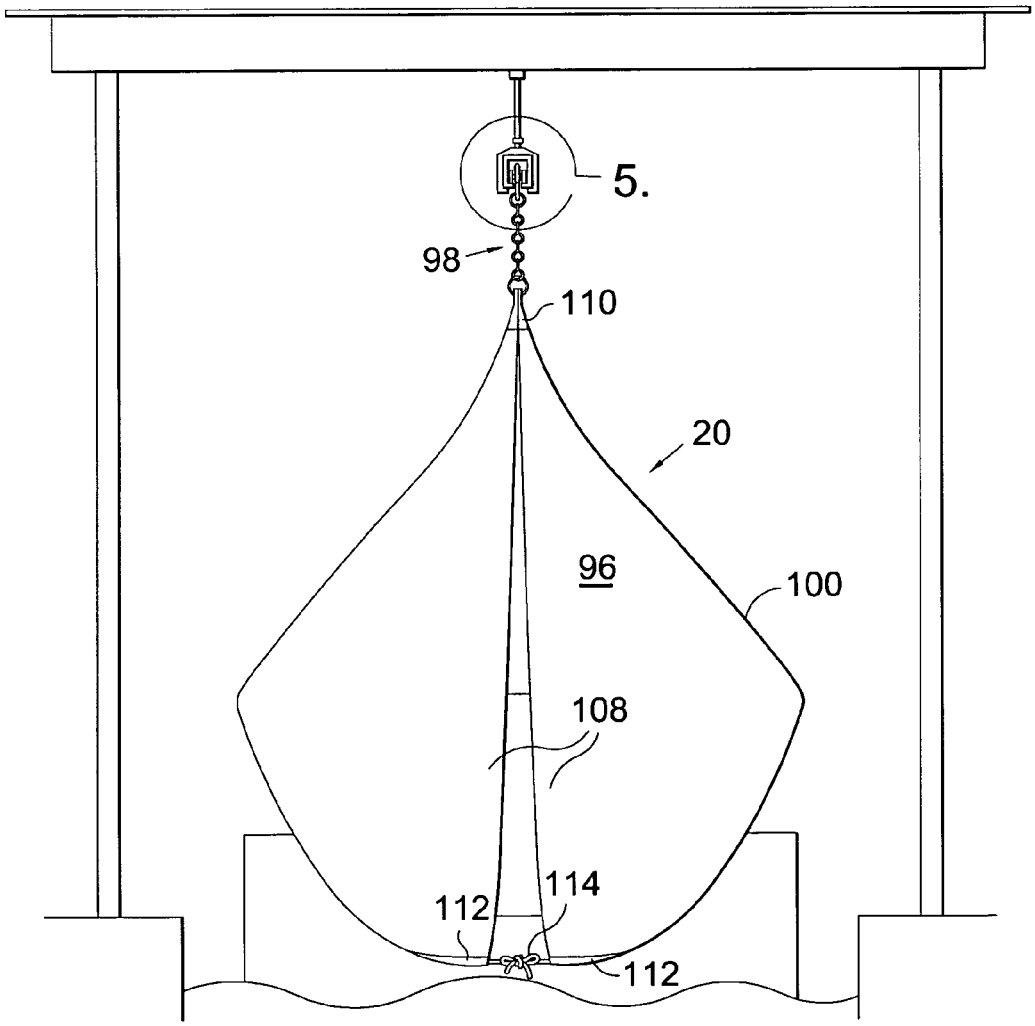
FIG. 3 is a rear-elevation view of the boat cover system of FIG. 2.

Referring now to FIGS. 1–3, the cover assembly 20 will be discussed. The cover assembly 20 consists of a cover 96 and an attachment member 98. The cover 96 is made from a nylon material and may be adapted to fit virtually any size boat. However, it should be understood by one of ordinary skill in the art that any suitable material may be used. As shown in FIG. 2, the cover 96 contains a pair of sides 100, each having a top 102, a bottom 104, a front 106, and a rear 108. The pair of sides 100 are connected at the top 102 to form a reinforced section 110. The pair of sides 100 are also connected at the front 106. Thus, the cover 96 is constructed like a standard pillowcase with the exception that the sides 100 are not connected at the bottom 104. The bottom 104 of each side 100 contains a fold portion 112 proximate the rear 108. The fold portion 112 houses a rope 114 that when tied, see FIG. 3, is used to snug the cover 96 around the boat. As stated above, the sides 100 are coupled together at the top 106 to form the reinforced section 110. The reinforced section 110 further contains a plurality of eyelets 116 that are located in the reinforced section 110. As shown in FIGS. 1 and 4, the attachment member 98 is attached at one end 118 to the eyelets 116 and at another end 120 to the aperture 91 in the rollers 62, 92. As such the attachment member 98 serves to interconnect the roller assembly 18 and the cover assembly 20. The attachment member 98 is shown to be a chain, however, it should be appreciated by one of ordinary skill in the art that any suitable attachment member may be used.

Referring now to FIGS. 1 and 2 the operation of the boat cover system 10 will now be discussed. FIG. 1 shows the boat cover system 10 in a first position where the boat 14 is uncovered. FIG. 2 shows the boat cover system 10 in a second position where the boat 14 is covered. To move the cover assembly 20 from the first position to the second position the user simply pulls downwardly on a side of the second cord 66. It should be understood that pulling downwardly on one side of the second cord 66 will move the cover assembly 20 from the first position to the second position while pulling downwardly on another side of the second cord 66 will move the cover from the second position to the first position. Pulling downwardly on a side of the second cord 66 causes the second pulley 58 to rotate, which, in turn causes the first pulley 56 to rotate due to the interconnection by the first cord 64. The cover assembly 20 moves from the first to second positions due to the fact that the cord is attached to the roller pulley 92. Thus, movement of the second cord 66, in turn, causes movement of the first cord 64, which in turn, causes movement of the cover assembly 20. Once the cover assembly 20 is moving from the first position to the second position, the user simply has to make sure that each side 100 of the cover 96 covers a side of the boat 14. Once the cover assembly 20 has been moved to the second position, the ropes 114 may be tied to enclose the boat 14 within the cover 96.

It should be understood that while the cover assembly 20 can be moved from the first position to the second position by the pulleys 56, 58, 60 and cords 64, 66 of the roller system 18, the pulleys 56, 58, 60 along with the cords 64, 66 are not necessary for movement of the cover assembly 20 from the first position to the second position. Specifically, the roller system 18 can move the cover assembly 20 from the first position to the second position without the need for the pulleys 56, 58, 60 and cords 64, 66. As such, a user of the boat cover system 10 can move the cover assembly 20 from the first position to the second position by simply grabbing the rear portion 108 of the cover 96 and walking down the dock until the cover 96 covers the boat 14.

It should be understood that while the cover system 10 has been described for covering a boat the cover system 10 may also be used to cover any coverable item and may be attached to any suitable enclosure.

The present invention has been described in relation to particular embodiments, which are intended in all respects to be illustrative rather than restrictive. Alternative embodiments will become apparent to those skilled in the art to which the present invention pertains without departing from its scope. It will be seen from the foregoing that this invention is one well adapted to attain the ends and objects set forth above and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A cover assembly for covering a coverable item, the cover assembly being attached to an existing structure, the cover assembly including:

a track assembly including at least one section of track and a coupling assembly for attaching the track assembly to the existing structure; and a cover coupled to the track, the cover having an open end and first and second downwardly extending members, and being adapted to move from a first position to a second position, first and second downwardly extending members being located outwardly of the coverable item when the cover is moved to the second position.

2. The cover assembly of claim 1, wherein the cover is coupled to the track by a roller assembly.

3. The cover assembly of claim 2, wherein the roller assembly includes a pulley system, the pulley system being adapted to move the cover from a first position to a second position.

4. The cover assembly of claim 3, wherein in the first position the coverable item is uncovered and in the second position the coverable item is covered.

5. The cover assembly of claim 4, wherein the roller assembly includes at least one roller, the roller being coupled to the pulley system.

6. The cover assembly of claim 5, wherein the roller assembly includes a plurality of rollers.

7. The cover assembly of claim 6, wherein the track includes a plurality of sections.

8. The cover assembly of claim 7, wherein the sections are interconnected by a coupler.

9. The cover assembly of claim 8, wherein the pulley system includes a pair of pulleys, the pair of pulleys being coupled to one another.

10. The cover assembly of claim 9, wherein the pair of pulleys lie in the same plane.

11. The cover assembly of claim 10, wherein at least one of the pair of pulleys is a double pulley.

12. The cover assembly of claim 11, wherein the pulley system further includes a third pulley positioned remotely from the pair of pulleys, the third pulley being coupled to the pair of pulleys.

13. A boat cover system for covering a boat, the boat cover system being attached to an existing structure, the boat cover system including:

a track assembly including at least one section of track and a coupling assembly for attaching the track assembly to the existing structure;

a roller assembly slidingly coupled to the track; and a cover coupled to the roller assembly, the cover having an open end and a pair of sheet members;

wherein the roller assembly is adapted to move the cover from a first position to a second position, each of the pair of sheet members being located outwardly of the boat when the cover is moved to the second position.

14. The boat cover system of claim 13, the roller assembly having a pulley system, wherein the pulley system is adapted to move the cover from a first position to a second position.

15. The boat cover system of claim 14, wherein the roller assembly includes at least one roller, the roller being coupled to the pulley system.

16. The boat cover system of claim 15, wherein the roller assembly includes a plurality of rollers.

17. The boat cover system of claim 16, wherein the track includes a plurality of sections.

18. The boat cover system of claim 17, wherein the sections are interconnected by a coupler.

19. The boat cover system of claim 18, wherein the sections have a rectangular cross-section.

20. The boat cover system of claim 19, wherein the pulley system includes a pair of pulleys, the pair of pulleys being coupled to one another.

21. The boat cover system of claim 20, wherein at least one of the pair of pulleys is a double pulley.

22. The boat cover system of claim 21, wherein the pulley system further includes a third pulley positioned remotely from the pair of pulleys, the third pulley being coupled to the pair of pulleys.

* * * * *